US005279132A

United States Patent [19]

Swaim

[11] Patent Number: 5,279,132

[45] Date of Patent: Jan. 18, 1994

[54] HOLDING DEVICE

[76] Inventor: Penny E. Swaim, 915 Dogwood Ave., Fort Lupton, Colo. 80621

[21] Appl. No.: 932,554

[22] Filed: Aug. 20, 1992

[51] Int. Cl.[5] ..... A44C 25/00

[52] U.S. Cl. ..... 63/2; 63/DIG. 1

[58] Field of Search ..... 63/2, DIG.

[56] References Cited

U.S. PATENT DOCUMENTS

| | | | |
|---|---|---|---|
| 1,528,882 | 3/1925 | Kennerly | 63/DIG. 1 |
| 2,096,389 | 10/1937 | Bode | 63/DIG. 1 |
| 2,688,324 | 9/1954 | McCarthy | 63/2 |
| 2,879,567 | 3/1959 | O'Connell | 63/DIG. 1 |
| 3,119,389 | 1/1964 | Ritzcovan | 63/2 |
| 3,481,155 | 12/1969 | Cook | 63/2 |
| 4,220,016 | 9/1980 | Frenger | 63/DIG. 1 |
| 4,628,708 | 12/1986 | Ivey | 63/2 |
| 4,754,534 | 7/1988 | Helwick | 63/2 |
| 4,974,430 | 12/1990 | Turner | 63/DIG. 1 |
| 5,081,853 | 1/1992 | Salyer | 63/DIG. 1 |

OTHER PUBLICATIONS

CIBA Consumer Pharmaceuticals, Bulletin on Transderm Slop (Jun. 1988) (2 pages).

Ornamental Resources, Inc. Catalog (1 page).

Adhesive Research, Inc., Bulletin on ARcare 7770 (1 page).

Adhesive Research, Inc. Bulletin on ARcare 7148 (1 page).

*Primary Examiner*—Peter M. Cuomo

*Assistant Examiner*—Michael J. Milano

*Attorney, Agent, or Firm*—Michael A. Capraro; Norvell E. Von Behren

[57] ABSTRACT

A holding device for use with body adornments such as necklaces, bracelets, anklets, waist chains and the like so that the body adornment may be held in place on a wearer's body to prevent the body adornment from becoming displaced thereby maintaining proper orientation of the body adornment on the wearer's body. The holding device further allows the wearer to easily and readily adjust the effective length of the body adornment. The holding device utilizes removably replaceable adhesive that affixes the body adornment to a wearer's skin or clothing, the adhesive being of the type suitable for energetic activity as well as humid conditions. Also disclosed is a method for attaching a body adornment to the wearer's body or clothing.

2 Claims, 3 Drawing Sheets

HOLDING DEVICE

BACKGROUND OF THE INVENTION

This invention relates generally to holding devices that may be used with body adornments such as necklaces, bracelets, anklets, waist chains and the like and more specifically to a new and improved holding device which allows the body adornment to be held in place on a wearer's body thereby preventing the body adornment from becoming displaced so that proper orientation of the body adornment on the wearer's body is maintained. The new and novel holding device is designed to be used with a variety of body adornments and particularly designed to allow the wearer to position the body adornment in a desired orientation on the wearer's body.

Many necklaces and other body adornments are designed so that the decorative ornament such as a pendant, trinket or bauble is movably attached to the chain, string, leather strand, beads or other material that a person may wear around their neck or other body part such as the wrist, arm, leg, ankle, waist and the like. The decorative ornament is often attached to the necklace by a ring or similar attaching means that allows the chain, string, leather strand, beads or the like to move freely though the ring or similar attaching means. When a person places the necklace or other body adornment around their neck or other body part, the clasp which fastens the two ends of the necklace together has a tendency to creep or walk from it's initial position at the back of the wearer's neck to the front of the wearer's body, often coming to rest adjacent to the decorative ornament such as a pendant, trinket or bauble that may be attached to the necklace.

Even in necklaces where the decorative ornament is attached to the chain, string, leather strand, beads or similar material in a manner that holds the decorative ornament in a fixed position relative to the chain or similar material, the clasp or fastening means at the back of the neck has a tendency to creep or walk around to the front of the wearer's body. The result is a displaced decorative ornament or, in the extreme, reversal of the initial position of the clasp and the decorative ornament, especially if the wearer is engaged in an energetic activity.

In both types of necklaces, those with movably attached decorative ornaments and those with fixed decorative ornaments, creeping or walk-around of the clasp from the back of the neck to the front of the neck leads to unsightly body adornment and frustration of the wearer in having to constantly readjust the necklace to its proper orientation. The creeping or walk-around problem has been observed in other types of body adornments as well such as bracelets, anklets, waist chains and the like.

Another problem encountered with body adornments has been the unavailability of an easy and reliable way of adjusting the length of the chain, string, leather strand, beads or similar material without damaging the chain or similar material and without total replacement of the chain or similar material with one of the desired length. One solution has been to place the chain or similar material in a device that grips the chain in a manner that reduces the size of the loop created when the ends of the chain are fastened together. These types of devices generally require someone other than the wearer to make the adjustment as the device is located behind the wearer's neck and adjustment is difficult. Additionally, these type of devices often damage the chain or similar material the necklace is made of.

There are two other critical problems with the gripping type of adjustment device. First, the gripping device can not be used with necklaces, bracelets, anklets, waist chains or other body adornments that utilize beads or other thick materials to make up the "chain" portion of the adornment. Secondly, and most importantly, the weight of the gripping type device can actually increase the tendency of the clasp to creep or walk around the wearer's neck or other body part.

Another solution to the adjustment problem has been to simply replace the "chain" portion of the body adornment with one of the desired length. Not only is this costly but it is also time consuming for the wearer to constantly change the "chain" portion of the necklace depending on the length the wearer desires to have.

SUMMARY OF THE INVENTION

To overcome the before described considerations and problems inherent in and encountered with prior art holding devices and solutions, there is provided by the subject invention a unique holding device that may be used with body adornments such as necklaces, bracelets, anklets, waist chains and the like. The new and novel holding device provides a positive attachment means to maintain proper orientation of the body adornment preventing creeping or walk-around while allowing the wearer to easily and reliably adjust the body adornment to a position desired by the wearer.

To alleviate the creeping or walk-around problem, applicant's new and novel holding device for use with body adornments such as necklaces, bracelets, anklets, waist chains and the like is formed from a disc, charm or the like that has a surface capable of receiving a double-sided adhesive, spray adhesive or brush on adhesive. The holding device is then attached to the body adornment in a manner that allows the wearer to then press the holding device against the wearer's skin thereby temporarily adhering the device to the wearer's body. Thus, the body adornment is held in place on the wearer's body and proper orientation of the adornment is maintained. The body adornment may also be held in place and proper orientation maintained by pressing the holding device to the wearer's shirt, blouse or other clothing thereby temporarily adhering the device to the wearer's clothing.

The adhesive is of the type designed to be removable so that it may be replaced by the wearer when its adhering ability is lost. The disc, charm or the like may be replaced if the wearer desires to display a different disc, charm or the like or if the wearer wishes to replace the disc, charm or the like for any other reason.

Applicant's new and novel holding device in an embodiment is further designed to have a clasp or other fastening means with a surface capable of receiving the adhesive act as the receiving surface for the adhesive. Thus, on body adornments that do not lend themselves to the attachment of a separate receiving surface, applicant's new and novel holding device may nevertheless be utilized to overcome creeping or walk-around and to maintain proper orientation of the body adornment.

Applicant's new and novel holding device in another embodiment is further designed to have a decorative ornament with a surface capable of receiving the adhesive. The decorative ornament, which provides the primary aesthetic value of the necklace, may then be affixed to the skin or wearer's clothing at a desired position on the wearer.

Since applicant's new and novel holding device is designed to adhere to the wearer's skin, the holding device also provides a means to overcome the prior art adjustability problem. By placing the holding device higher or lower on back of the wearer, the position of the decorative ornament may be changed. On those body adornments lacking a decorative ornament, the effective length of the adornment can be changed by selective placement of the applicant's new and novel holding device on the wearer's skin as well.

Applicant's new and novel holding device in an embodiment is further designed to allow adjustment of the effective length of the body adornment while providing a positive fixed orientation and placement of the adornment simultaneously. This is accomplished by providing a holding device that secures the clasp area of the adornment to the wearer's back and one that secures the decorative ornament to the skin on the front of the wearer.

Accordingly, it is an object and advantage of the invention to provide a new and novel holding device that positively secures a portion of a body adornment to the wearer's skin or clothing preventing the clasp or fastening area of the adornment from creeping or walking-around the wearer's neck or other body part.

Another object and advantage of the invention is to provide a new and novel holding device that provides adjustment of the effective length of a body adornment allowing the wearer to easily and readily adjust the adornment to the desired length.

Yet another object and advantage of the invention is to provide a new and novel holding device that provides positive fixed placement of the decorative ornament of a body adornment on the wearer's body.

These and other objects and advantages will become apparent from review of the drawings and from a study of the Description of the Preferred Embodiment relating to the drawings which has been provided by way of illustration only.

DESCRIPTION OF THE PREFERRED EMBODIMENT

Figure 1:
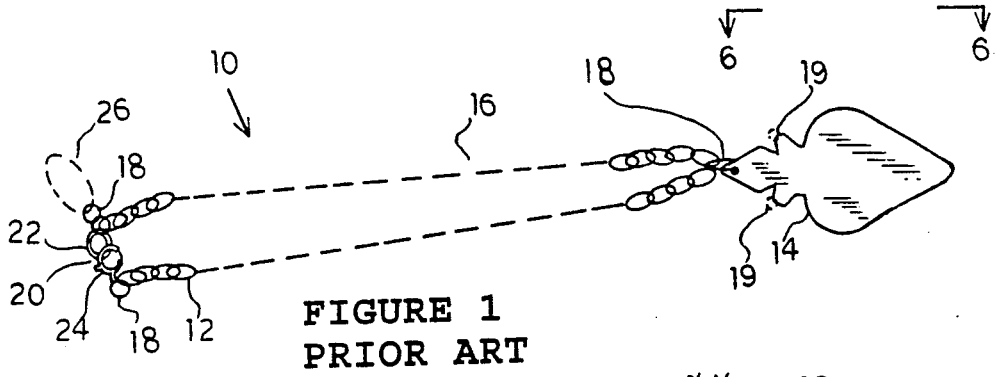
FIGURE 1 PRIOR ART
FIG. 1 is a perspective view of a typical prior art body adornment, the body adornment shown being a necklace.

Referring to the drawings in general and in particular to FIG. 1 of the drawings, there is shown a typical prior art body adornment shown generally by the numeral 10. The body adornment 10, shown in FIG. 1 as a necklace, has been designed to illustrate typical prior art neck adornments. Other body adornment configurations such as bracelets, anklets, waist chains and the like can be used with one or more embodiments of the applicant's new and novel invention.

An elongated member 12, such as a chain, may have at least one decorative ornament 14 movably or fixedly attached to the interim portion 16 of the elongated member or chain 12 by attaching means 18 known in the art. In FIG. 1, the interim portion 16 of the chain 12 has been shown in dashed lines. The decorative ornament 14 is attached to the front portion of the chain 12. The chain 12 may have no decorative ornament 14 attached.

On body adornments 10 having at least one decorative ornament 14 movably attached to the interim portion 16 of the chain 12, the attaching means 18 is generally of the type known in the art as a split ring, jump ring, kidney ring or the like. The attaching means 18 is appended to the decorative ornament 14 and allows the interim portion 16 of the chain 12 to freely pass through the attaching means 18 permitting the interim portion 16 to move in relation to the decorative ornament 14.

On body adornments 10 having at least one decorative ornament 14 fixedly attached to the interim portion 16 of the chain 12, the attaching means 18 is generally of the type known in the art as a split ring, jump ring, kidney ring or the like. The attaching means 18 is appended to at least two different points 19 on the decorative ornament 14. At least two ends of the chain 12 are then connected to the decorative ornament 14 by the attaching means 18 at points 19. This arrangement does not allow the interim portion 16 of the chain 12 to freely pass through the attaching means 18 and holds the decorative ornament 14 in a fixed position relative to the interim portion 16 of the chain 12.

Two other ends of the chain 12 are connected together by a fastening means 20. The fastening means 20 is of the type generally referred to as a clasp in the body adornment art and may comprise a first fastening part 22 and a second fastening part 24. The fastening means 20 may be a hook and eye, hook and bar, spring ring, barrel screw or other fastening means known in the art. For additional information on these types of fastening means see generally: Ornamental Resources, Inc. Catalog filed herewith as prior art.

A chain tag 26, shown in dashed lines in FIG. 1 of the drawings, may be removably attached near the back or fastening end of the chain 12 by means known in the art and is shown in FIG. 1 in dashed lines for purposes of clarity. The prior art type body adornment 10 may have no chain tag 26 attached.

Figure 2:
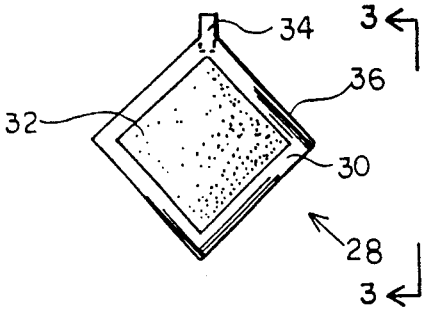
FIG. 2 is a plan view of applicant's new and novel holding device.
Figure 3:
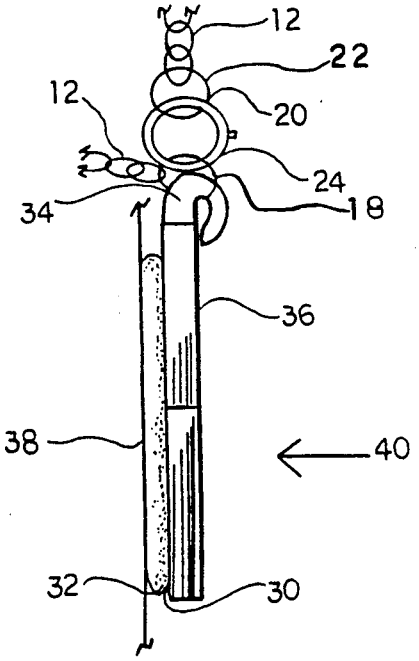
FIG. 3 is an end view of applicant's new and novel holding device taken along lines 3—3 of FIG. 2.

Referring now to generally to FIGS. 2 and 3 of the drawings there will be described in detail applicant's new and novel holding device shown generally by the numeral 28. FIG. 3 is an end view taken along lines 3—3 of FIG. 2. The holding device 28 has formed thereon at least one receiving surface 30, the receiving surface 30 being designed to receive a holding means 32. The holding device 28 shown in the Preferred Embodiment with at least one receiving surface 30 has been designed to illustrate the new and novel desired result. The receiving surface 30 may be a disc, charm, chain tag or the like and may be formed from metal, plastic, paper, foil or the like and may be formed in various shapes as desired. Other receiving surface configurations are considered to be within the spirit and scope of the applicant's invention.

A holding means 32 is affixed to the receiving surface 30. The holding means 32 may be an adhesive of the type generally known as double-sided tape, spray adhesive or brush on adhesive. One type that has been found to be satisfactory is a high tack double coated pressure sensitive film tape known as ARcare 7770® as manufactured by Adhesive Research, Inc. of Glenn Rock, Pa. This material is detailed in the specification sheet filed with this application as prior art. Other adhesive materials may also be used which will have the necessary qualities as outlined hereinafter and are considered to be within the spirit and scope of the applicant's invention. For additional information on ARcare 7770® and other adhesives see generally: Adhesive Research, Inc. Bulletin on ARcare 7770®, Adhesive Research, Inc. Bulletin on ARcare 7148® and CIBA Consumer Pharmaceutical Bulletin on Transderm Scōp®.

With the adhesive 32 in place on the receiving surface 30 the holding device 28 is then connected to an attaching means 18 near the fastening means 20 of a body adornment 10, which is not shown in its entirety for purposes of clarity, by a connecting means 34 in the form of a tab. The tab 34 is continuously formed from the main body 36 of the holding device 28 allowing the holding device 28 to be attached to a body adornment 10 by means known in the art. Fastening means and connecting means are available in many forms and the attachment shown is one particular type that can be used with the applicant's novel invention. The holding device 28 would be attached near the fastening means 20 at the back of the chain 12. Other connecting means are considered to be within the spirit and scope of the applicant's invention.

The holding device 28 is pressed against a wearer's skin 38 in the direction of the arrow 40 as shown in FIG. 3. The holding device 28 will then adhere to the wearer's skin 38 at the position selected by the wearer. The holding device 28 may also be pressed to the wearer's shirt, blouse or other clothing thereby temporarily adhering the device to the wearer's clothing. Since the holding device 28 is connected to the attaching means 18 of the body adornment 10, the adhesive 32 on the holding device 28 prevents the chain 12 of the body adornment 10 from creeping or walking-around the neck of the wearer as the wearer moves. While the adhesive 32 in an embodiment is applied to the receiving surface 30 of the main body 36 of the holding device 28, the adhesive 32 may also be applied to an existing chain tag 26 of the type shown in dashed lines in FIG. 1 of the drawings.

The double-sided pressure sensitive medical tape used as the holding means 32 and known as ARcare 7770®, as previously described, has been found to be particularly well suited for those wearers who desire to wear body adornments while engaged in energetic activities such as running, jogging, racquetball, other sports or other energetic activities that may cause the clasp portion of a body adornment to creep or walk-around the wearer's neck or other body part. Sweating from such activities has minimal effect on the adhering ability of the product ARcare 7770®. Normal activities such as office work, house-cleaning, walking or similar activities can also cause the body adornment to creep or walk-around the wearer's body in a normal situation when the adornment does not use the applicant's novel invention.

Additionally, ARcare 7770 is well suited for humid environments such as a hot-tub, jacuzzi, shower or the like where the wearer may desire not to remove the body adornment. The ARcare 7770® adhesive used in the Preferred Embodiment will adhere to a wearer's skin 38 for at least one day under normal conditions and may also adhere for up to three days or more without adverse effects on the wearer's skin 38.

Suitable adhesives 32 may be types generally used in transdermal drug delivery systems. They are non-sensitizing adhesives which can be applied to skin and are non-cytotoxic as well as non-irritating. While generally available in roll form which is applied to a central clear, thin, flexible plastic film on both sides, these adhesives may also be available in a spray can or may be applied with a brush from a bottle containing the adhesive.

Other adhesive materials may also be used which will have the necessary qualities as outlined and are considered to be within the spirit and scope of the applicant's invention. For additional information on ARcare 7770® and other adhesives see generally: Adhesive Research, Inc. Bulletin on ARcare 7770®, Adhesive Research, Inc. Other suitable adhesives may be ARcare 7148® shown in the Bulletin on ARcare 7148® and Transderm Scōp® shown in the CIBA Consumer Pharmaceutical Bulletin on Transderm Scōp®.

Figure 4:
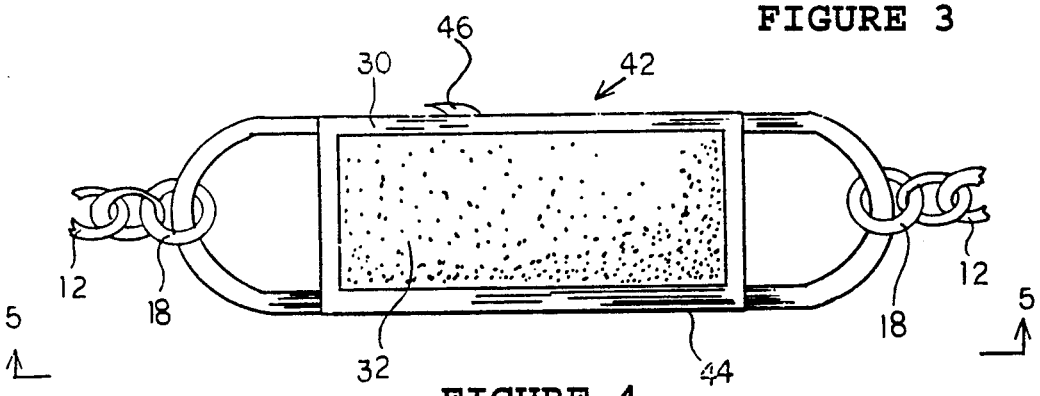
FIG. 4 is a plan view of a first modification of applicant's new and novel holding device.
Figure 5:
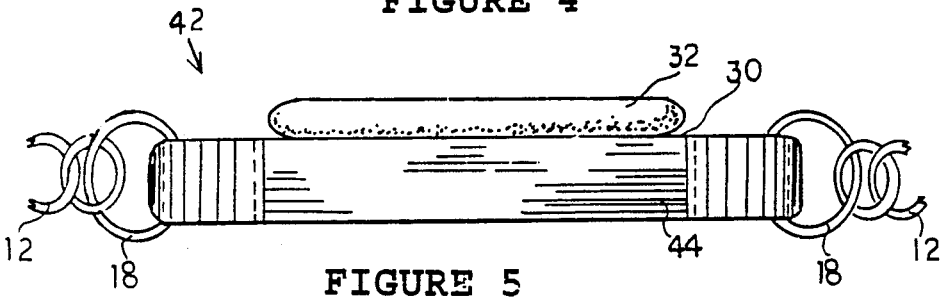
FIG. 5 is an end view of a first modification of applicant's new and novel holding device taken along lines 5—5 of FIG. 4.

Referring now to FIGS. 4 and 5 of the drawings, there is shown a first modification of applicant's new and novel holding device shown generally by the numeral 42. FIG. 4 is a plan view of the first modification. FIG. 5 is an end view of the first modification of applicant's new and novel holding device taken along lines 5—5 of FIG. 4.

There are many different types of fastening means available in the jewelry art for connecting ends of a chain 12 together so that the chain 12 may be worn around a part of the body. A particular type of fastening means that is "flattened" is known as a fish-hook clasp and is referred to by the numeral 44 in FIGS. 4 and 5. This type of fastening means is shown in the prior art materials filed herewith. Other types of prior art fastening means may also be modified to include the applicant's novel invention.

The flattened fastening means or fish-hook clasp 44 is constructed in two parts that may lock together when connected. One part of the fastening means 44 is shaped in the form of a fishing hook except that the normally pointed end is rounded and dull and the "barb" 46 points to the outside of the "hook" instead of the inside as on a fishing hook. The other end of the "hook" portion is similar to a fishing hook in that it has a loop or eyelet formed on the end for the purpose of attaching that portion of the clasp to the chain 12. This portion of the clasp is constructed of a spring like material so that the "hook" springs back to its original shape when the ends are squeezed together and then released.

The other part of the fish-hook clasp 44 is an essentially rectangularly shaped box with an open end into which the "hook" portion of the fish-hook clasp 44 fits. A small opening in the side of the rectangular box portion of the fish-hook clasp 44 allows the "barb" 46 to protrude through the side of the box locking the two parts together. Similar fastening means may be constructed as one piece alleviating the necessity for a locking mechanism.

A fish-hook clasp 44, is connected to the chain 12 of a body adornment 10 by attaching means 18 such as a split ring or clip of the type known in the art. The adhesive 32 is affixed to a suitable receiving surface 30 on the fish-hook clasp 44. The fish-hook clasp 44 in the first modification shown is typical of the type generally known and has been designed to illustrate the new and novel desired result on this type of clasp. Other fastening means having similar flattened surfaces that are suitable for receiving the adhesive 32 are considered to be within the scope and spirit of the invention.

The application of the adhesive 32 to the first modified holding device 42 permits the first modified holding device 42 to perform in a manner identical to the holding device 28 hereinbefore described. The first modification allows the wearer to choose which holding device, holding device 28 or the first modification 42, is best suited for a particular body adornment.

Figure 6:
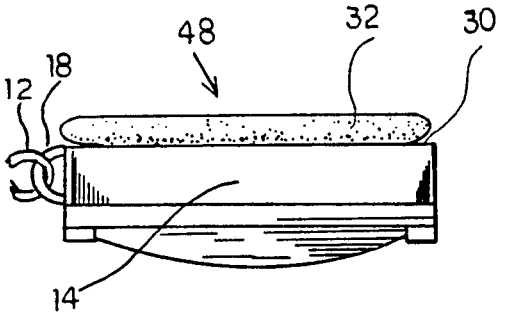
FIG. 6 is an end view of a second modification of applicant's new and novel holding device.

Referring now to FIG. 6 of the drawings, there is shown a second modification of applicant's new and novel holding device shown generally by the numeral 48. FIG. 6 is an end view taken along lines 6—6 of FIG. 1. A decorative ornament 14, of the type shown in FIG. 1 of the drawings, is connected to the chain 12 of a body adornment 10, which has not been shown in its entirety for purposes of clarity, by a typical attaching means 18 of the type known in the art. The decorative ornament 14 has a suitable receiving surface 30 on which the adhesive 32 can be affixed. The decorative ornament 14 in the Preferred Embodiment shown has been designed to illustrate the new and novel desired result when the applicant's novel invention is applied to a decorative ornament hanging on the front of the body of the user. When this embodiment is used, the decorative ornament 14 would be the type that is large enough to hold the adhesive 32 and also to permit the adhesive 32 to be hidden from view when applied to back of the decorative ornament 14.

The second modified holding device 48 shown in FIG. 6 allows the wearer to affix the decorative ornament 14 to a desired place on the body preventing movement and maintaining proper orientation of the decorative ornament 14 at the selected location. The second modified holding device 48 may be used in conjunction with the first modified holding device 42, shown in FIGS. 4 and 5, or in conjunction with the holding device 28, shown in FIGS. 2 and 3, to maintain proper orientation and placement of the decorative ornament 14 and also to prevent creeping or walk-around of the fastening means 20 of a body adornment 10.

Figure 7:
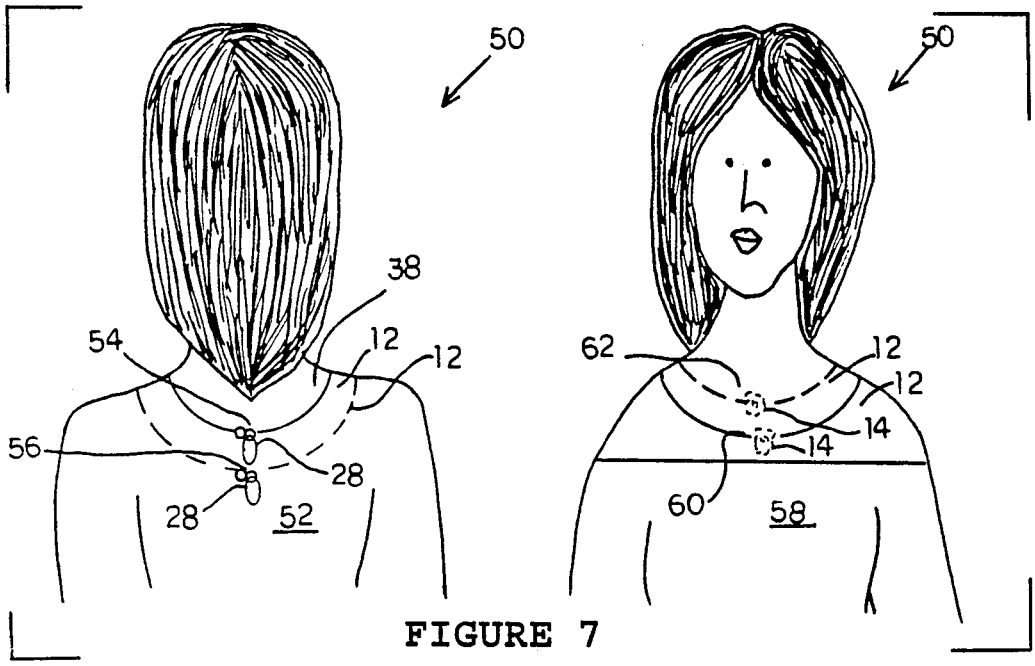
FIG. 7 is a perspective view showing the front and back of a person wearing applicant's new and novel holding device, the holding device being shown in different positions on the person.

Referring now to FIG. 7 of the drawings, there is shown how applicant's new and novel holding device 28 or modified holding device 42 may be used with a body adornment 10, such as a necklace, worn by a person or wearer shown generally by the numeral 50. The holding device 28 or modified holding device 42 is affixed to the skin 38 of the wearer's back 52 to set the front decorative ornament 14 in its desired place on the chain 12. The holding device 28 or modified holding device 42 may also be affixed to the wearer's shirt, blouse or other clothing.

The holding device 28 maybe placed in a high position 54 or low position 56 on the wearer's back 52. The chain 12 is shown as a solid line in the high position and is shown as a dashed line in the low position. The choice of location on the wearer's back 52 affects the ultimate position of the decorative ornament 14, shown in FIG. 7 by dashed lines for purposes of clarity, on the front 58 of the person 50. If the person 50 selects a high position 54 on the back 52, the decorative ornament 14 locates at a low position 60 on the wearer's front 58. If the person 50 selects a low position 56 on the wearer's back 52, the decorative ornament 14 locates at a high position 62 on the wearer's front 58.

In those cases where the wearer 50 has chosen a body adornment 10 that has no decorative ornament 14, the selected position on the wearer's back 52 effectively alters the apparent length of the body adornment 10. By selecting a high position 54 on the wearer's back 52, the body adornment 10 appears to be lengthened. By selecting a low position 56 on the wearer's back 52, the body adornment 10 appears to be shortened. After the desired position is selected, the holding device 28 or 42 is adhered to the skin by the adhesive 32. The positions for adjustment in the embodiments shown have been designed to illustrate the new and novel desired result.

The person 50 may also choose to utilize the second modification 48 as hereinbefore described to anchor the decorative ornament 14 to the person's front 58 to maintain proper orientation of the decorative ornament 14 on the person's front 58. The person 50 may also combine a modified holding device embodiment 42 or 48 with the holding device 28 to further secure the body adornment 10 and to prevent creeping or walk-around of the fastening means 20. This would then secure the chain 12 to two places on the body, one on the front 58 and one on the back 52.

It should be noted that applicant's new and novel holding device 28 or modified holding device 42 can be easily and readily placed at the desired location on the person's back 52 by the person 50. There is no need for another person to assist the person 50 in the placement or removal of the holding device 28 or the modified holding device 42 on the person's 50 body.

Additionally, since the adhesive 32 is designed to be removable, the person 50 may replace the adhesive 32 when necessary to maintain the adhering ability of the adhesive 32 to the person's skin 38 or clothing or to the receiving surface 30. As hereinbefore described, this replacement of the adhesive 32 may be every day or as long as every three days depending upon various conditions.

Figure 8:
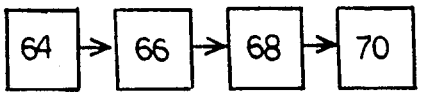
FIG. 8 is a block diagram showing the applicant's new and novel method.

Referring now to FIG. 8 of the drawings, there will be described the new and novel method which is used to produce and utilize the holding device. The first step in the method, shown by the numeral 64, is to provide at least one body adornment. In the next step, shown by numeral 66, the at least one body adornment is provided with at least one receiving surface. The third step, shown by the numeral 68, provides at least one holding means, the holding means being formed and positioned on the receiving surface. Finally, in the step shown by the numeral 70, the at least one holding means is then affixed to a wearer at a position selected by the wearer.

Figure 9:
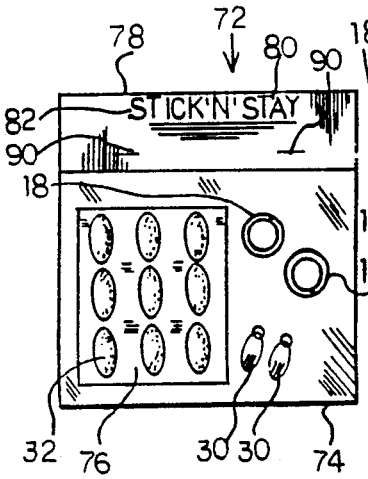
FIG. 9 is a front view of applicant's new and novel holding device as packaged in one embodiment.
Figure 10:
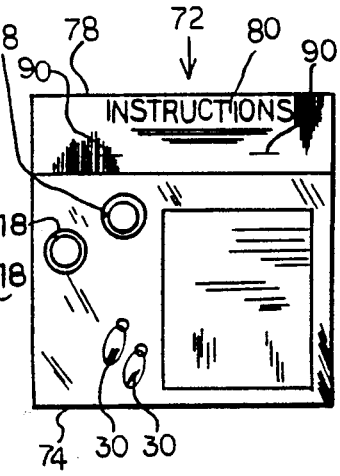
FIG. 10 is a rear view of the package shown in FIG. 9.
Figure 11:
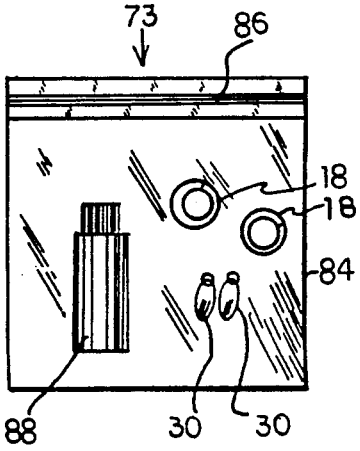
FIG. 11 is a front view of applicant's new and novel holding device as packaged in a Zip-lock ® bag.

Referring now to FIGS. 9 and 10 of the drawings there will be described in detail one type of package, generally shown by the numeral 72, for applicant's new and novel holding device. There is also shown in FIG. 11 another type of package generally shown by the numeral 73. The applicant's invention may be packaged in a Zip-lock® type of bag or in a plain plastic bag using a headliner.

A container 74 is provided to hold the various items necessary to utilize applicant's new and novel holding device. The container 74 may be a plastic bag, bubble pack or the like and in the Preferred Embodiment shown has been designed to illustrate the appropriate packaging. The container may also be a Zip-lock® bag 84 as shown in FIG. 11. Other packaging is considered to within the spirit and scope of the invention.

A plurality of different types of attaching means 18 may be provided in various shapes and sizes for use in attaching a holding device 28 to a wearer's chain 12. Receiving surface 30 may also be provided. The receiving surface 30 may be provided in various shapes and sizes to offer the potential purchaser a variety of receiving surfaces 30 from which to choose.

Several adhesive holding means 32 may be provided on a card 76, the holding means 32 being a double-sided tape of the type hereinbefore described and being precut to approximate the shape and size of the holding device 28. The adhesive holding means 32 may be double-sided pressure sensitive medical tape of the type generally known as ARcare 7770® as hereinbefore described. The adhesive holding means 32 may also be supplied in the form of a spray adhesive, brush on adhesive or the like as shown by numeral 88 in FIG. 11 of the drawings. A Zip-lock® type plastic bag 84 may be used with the lock 86 being used to retain the contents inside the package. The Zip-lock® bag 84 may also be used to replace the bag type shown in FIGS. 9 and 10.

The above items are then packaged in the container 74 or 84 in a manner that allows the potential purchaser to easily and readily view the contents of the container. A headliner 78 may also be attached to the container 74 as shown. The headliner 78 may be stapled at 90 to the container 74 and may have printed indicia 80 which provides information about the product including but not limited to the product name 82, product function, instructions and the like.

Figure 12:
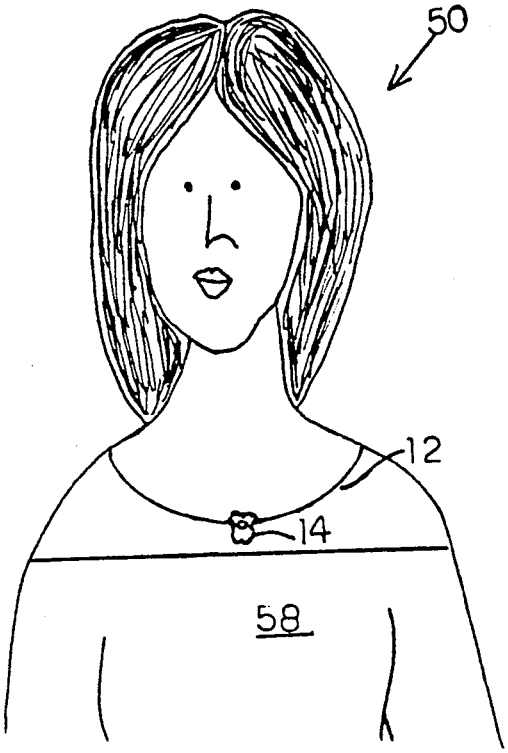
FIG. 12 is a perspective view showing the front of a person wearing applicant's new and novel holding device, the holding device being attached to the wearer's body at the front middle portion of the upper torso of the wearer's body.

Referring now to FIG. 12 of the drawings, there is shown the location of the decorative ornament 14 on the wearer's front 58 when used with the second modified holding device 48 shown in FIG. 6. The wearer, shown generally by the numeral 50, may select an appropriate position on the wearer's front 58 to secure the decorative ornament 14, thereby maintaining proper orientation and placement of the decorative ornament 14. The dashed lines shown in the right portion of the similar FIG. 7 drawing have been removed for purposes of clarity.

In summary, referring to the drawings in general, applicant's new and novel holding device 28, with adhesive holding means 32 affixed to the receiving surface 30, adheres to the wearer's skin 38 preventing the elongated portion 12 of a body adornment 10 from creeping or walking-around that part of the wearer's body around which the body adornment 10 has been placed. The holding device 28 also maintains proper orientation of the body adornment 10 on the wearer's body. The adhesive holding means 32 may also be applied to an existing chain tag 26 to form a holding device 28. The holding device 28 may also be affixed to the wearer's shirt, blouse or other clothing.

In the first modification 42 of the applicant's new and novel invention, the adhesive holding means 32 is applied to a flattened fastening means 44 which has a suitable receiving surface 30. The flattened fastening means 44 is then affixed to the wearer's skin 38, or clothing, preventing the elongated portion 12 of a body adornment 10 from creeping or walking-around that part of the wearer's body around which the body adornment 10 has been placed. The first modification 42 also maintains proper orientation of the body adornment 10 on the wearer's body. Any fastening means having a suitable receiving surface 30 which will hold the adhesive 32 may be used to form the first modification 44.

In the second modification 48, the adhesive holding means 32 is attached to the back of a decorative ornament 14, having a suitable receiving surface 30, of a body adornment 10. The decorative ornament 14 may then be positioned at a desired location on the wearer's body. The second modification 48 maintains proper placement and orientation of the decorative ornament 14.

The adhesive holding means 32 may be in the form of a doublesided pressure sensitive tape. One suitable adhesive holding means has been found to be a double-sided pressure sensitive medical tape of the type generally known as ARcare 7770® as hereinbefore described. The adhesive holding means 32 may also be supplied in the form of a spray adhesive, brush on adhesive or the like.

The holding device 28, the first modification 42 and the second modification 48 as well as the application of an adhesive holding means to an existing chain tag 26 may be used alone or in combination with each other. Special circumstances or situations may make it desirable for a wearer to combine the holding device 28 and modifications 42 or 48 to maintain an aesthetically pleasing image especially in those situations where the wearer is engaged in a vigorous activity.

From the above it can be seen that the applicant's new and novel holding device accomplishes all of the object's and advantages presented hereinbefore. Nevertheless it is within the spirit and scope of the invention that changes in the applicant's basic device may be made and the Preferred Embodiment and in the several modifications shown and described herein have only been given by way of illustration.

Having described my invention, I claim:

1. A holding device for use with body adornments such as necklaces, bracelets, anklets, waist chains and similar body adornments which are formed with at least one elongated member, ends of the elongated member being connected together by a fastening means, the holding device being designed to hold the body adornment in place on a wearer's body to prevent the body adornment from becoming displaced thereby maintaining proper orientation of the body adornment on the wearer's body, comprising:

a. at least one holding means receiving surface formed and positioned in close proximity to the ends of the elongated member which are located at the rear of the wearer's body; and b. holding means attached to the receiving surface, the holding means having an outer holding surface removably attached to the wearer's body at the back middle portion of the wearer's neck and upper torso.

2. A holding device for use with body adornments such as necklaces, bracelets, anklets, waist chains and similar body adornments which are formed with at least one elongated member, ends of the elongated member being connected together by a fastening means, the holding device being designed to hold the body adornment in place on a wearer's body to prevent the body adornment from becoming displaced thereby maintaining proper orientation of the body adornment on the wearer's body, comprising:

a. at least one holding means receiving surface formed and positioned in proximity to the center of the elongated member; and b. holding means attached to the receiving surface, the holding means having an outer holding surface removably attached to the wearer's body at the front middle portion of the upper torso of the wearer's body.

* * * * *